US007211751B1

(12) United States Patent
Libby, II

(10) Patent No.: US 7,211,751 B1
(45) Date of Patent: May 1, 2007

(54) SWITCH FOR ELECTRIC CABLE WIRING

(75) Inventor: Charles A. Libby, II, Montoursville, PA (US)

(73) Assignee: Aslan Industries Corporation, Montoursville, PA (US)

( * ) Notice: Subject to any disclaimer, the term of this patent is extended or adjusted under 35 U.S.C. 154(b) by 0 days.

(21) Appl. No.: 11/454,556

(22) Filed: Jun. 16, 2006

(51) Int. Cl.
*H01R 33/96* (2006.01)

(52) U.S. Cl. ..... 200/51.12; 200/51.05; 200/51.06

(58) Field of Classification Search ..... 200/43.04, 200/43.08, 51 R, 51.05, 51.06, 51.09, 51.11, 200/51.12, 51.14, 51.17, 573, 574; 439/95, 439/624

See application file for complete search history.

(56) References Cited

U.S. PATENT DOCUMENTS 4,295,018 A * 10/1981 Borrelli ..... 200/51.09
5,077,991 A * 1/1992 Stickel et al. ..... 200/43.08
5,785,551 A 7/1998 Libby
5,975,938 A 11/1999 Libby
6,290,511 B1 * 9/2001 Edwards et al. ..... 200/51 R
6,566,767 B1 * 5/2003 Tardo ..... 200/51.11
2005/0064759 A1 3/2005 Libby et al.

* cited by examiner

*Primary Examiner*—Michael A. Friedhofer
(74) *Attorney, Agent, or Firm*—Thomas R. Shaffer

(57) ABSTRACT

A switch for selectively interconnecting wires of electric cable provides an enclosure having an input port and an output port and a toggle switch. A cam having cam arms is movable between a first position where the arms electrically connect and close contact points of return bus segments and a second position where the arms electrically connect and close contact points of a power bus segment and a return bus segment. A power bus extends in segments between the input port and the output port and has a main contact point selectively opened and closed by the toggle switch. The power bus has a power bus cam contact point selectively opened and closed by the cam. A return bus extends in segments between the input port and the output port and has return bus cam contact points selectively opened and closed by the cam. A ground bus extends between the input port and the output port. A second power bus and an auxiliary cam can be added for various three way switch wiring configurations.

14 Claims, 17 Drawing Sheets

FIG. 12
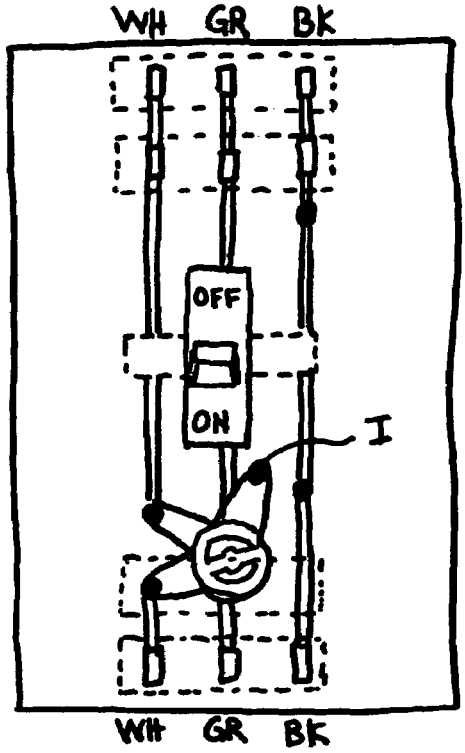
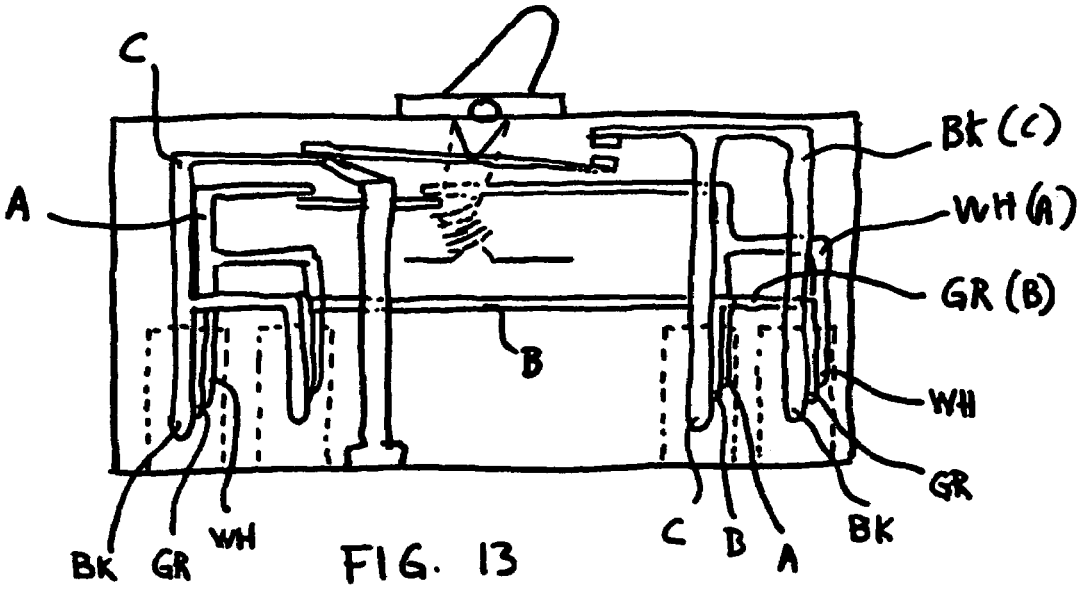
FIG. 13

SWITCH FOR ELECTRIC CABLE WIRING

BACKGROUND OF THE INVENTION

1. Field of the Invention

The present invention relates to a switch for electric cable wiring. More specifically, it relates to a pre-wired switch provided in an enclosure which allows for a simplified installation of various configurations of single pole electrical switches and three-way electrical switches in residential and commercial electrical wiring applications.

2. Description of the Prior Art

The wiring of three-way electrical cable switches so that one may turn a light on and off from two different locations is an extremely complex and time-consuming process. Even highly skilled electricians who all are familiar with such wiring arrangements must sometimes stop and think before completing this task. The complexity is caused primarily by the fact that there are identical switch light components which must be connected together with different wiring arrangements depending upon the relative location of each of the individual components and where the power feed comes from. Even with the more straightforward single pole switch, there are two different wiring configurations depending on whether the power from the breaker box first enters the switch or first enters the light itself.

Prior to the present invention, it has not been possible to provide a single fully enclosed switch housing or enclosure which would have the versatility for the same switch to be used in a variety of different wiring configurations. Having a fully enclosed switch enclosure is highly desirable as it saves considerable time, energy and expense of having an electrician manually connect wires to appropriate contact points on the switch. Further, and more importantly, the safety factor of utilizing a totally enclosed switch which is inaccessible to the installer is greatly increased over existing products and methods of electrical wiring. With the present invention, there is no possibility that an electrician or installer would be tempted to "test" a wired circuit before properly installing all box covers as there are no removable box covers. Thus, both risks of fire and electrocution are greatly reduced.

The concept of providing a modular system wherein male plugs would simply be inserted into corresponding female ports built into a prewired switch is suggested by Libby, U.S. Pat. No. 5,785,551. The Libby '551 patent teaches that it is desirable to reduce and simplify the number of steps required in wiring an electrical power distribution system and to make electrical connections without the need to strip the ends of the individual conductors in an electrical cable. FIGS. 1 through 10 show the typical manner in which the electrical wiring of a receptacle was accomplished in the past. FIGS. 11a–d and 12 of Libby '551 show and describe the use of a box into which male cable plugs are inserted into female connectors 46 provided in the box to simplify the wiring of the box. Applicant hereby incorporates by reference Libby, U.S. Pat. No. 5,785,551. The present invention relates to a new and improved box which includes a switch to provide greater flexibility and versatility than envisioned in the Libby '551 application.

SUMMARY OF THE INVENTION

The present invention in its simplest form adapted for use with a single pole switch provides a switch for electric cable wiring comprising: a) an enclosure having an input port and an output port; b) a main toggle switch; c) a cam having cam arms, said cam movable between a first position wherein said arms electrically connect and close contact points of adjacent return bus segments and a second position wherein said arms electrically connect and close a contact point of a power bus segment to a return bus segment; d) a power bus extending in segments between said input port and said output port, said power bus having a main contact point selectively opened and closed by said toggle switch, said power bus having a power bus cam contact point selectively opened and closed by said cam; e) a return bus extending in segments between said input port and said output port, said return bus having return bus cam contact points selectively opened and closed by said cam; and f) a ground bus extending between said input port and said output port.

Preferably, the enclosure has an exterior and said input port and said output port are accessible, from the exterior of the enclosure and the input port and said output port each provide a separate and independent connection to said power bus, said return bus and said ground bus. Preferably, the enclosure is factory sealed and has an interior which is inaccessible to an installer.

Preferably, the cam has three arm members. Preferably, one cam arm member has an electrically insulating material on one side thereof. Preferably, the cam has a shaft adapted for rotation between said first position and said second position. Preferably, the cam has a shaft which extends at least partially through an exterior of the enclosure and can be rotated between said first position to said second position from a location outside the enclosure. Preferably, the cam has an arm member which has a wedge like side surface for urging apart and opening a contact point on one of said bus segments when said cam is rotated between said first and said second postion.

When the present invention is utilized in connection with the more complex three-way switch the switch further comprises: g) a second power bus, said second power bus extending in segments between said output port and said power bus; and h) an auxiliary cam, said auxiliary cam having auxiliary cam arms and movable between a first auxiliary cam position wherein said auxiliary cam arms do not contact any bus and a second auxiliary cam position wherein said auxiliary cam arms electrically connect any contact point of said second power bus to a contact point of said power bus.

Preferably, said auxiliary cam has two arm members. Preferably, said auxiliary cam includes an auxiliary cam shaft adapted for rotation between said first auxiliary cam position and said second auxiliary cam position. Preferably, said auxiliary cam has an auxiliary cam shaft which extends at least partially through an exterior of the enclosure and said cam can be rotated between said first auxiliary cam position to said second auxiliary cam position from a location outside the enclosure. Preferably, said auxiliary cam has an auxiliary cam arm member which has a wedge like side surface for urging apart and opening a contact on one of said bus segments when said auxiliary cam is rotated between said first auxiliary cam position and said second auxiliary cam position.

BRIEF DESCRIPTION OF THE FIGURES

FIG. 12 is a top plan view of a single pole switch according to the present invention having a single cam.

FIG. 13 is a perspective view of the single pole switch according to FIG. 12.

DETAILED DESCRIPTION OF THE PREFERRED EMBODIMENTS

The present invention has utility in the installation of three-way electrical switch circuits as well as in the installation of single pole electric switch circuits. Three-way switch circuits will be described first. The purpose of a three-way switch is to be able to control the flow of electric current from two different locations. An example of this would be a light fixture located in the middle of a hall way and you turn the light on as you enter the hallway at one end and then turn the light off when you exit the hallway at the other end. This is done using two three-way switches.

Figure 1:
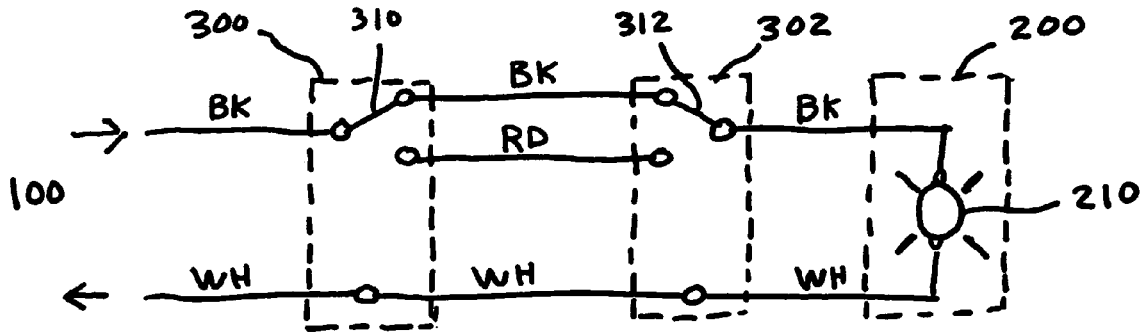
FIG 1 (PRIOR ART)
FIG. 1 is a schematic diagram of a prior art circuit for a three-way switch having a first switch, a second switch and a light with power, entering the first switch.
Figure 2:
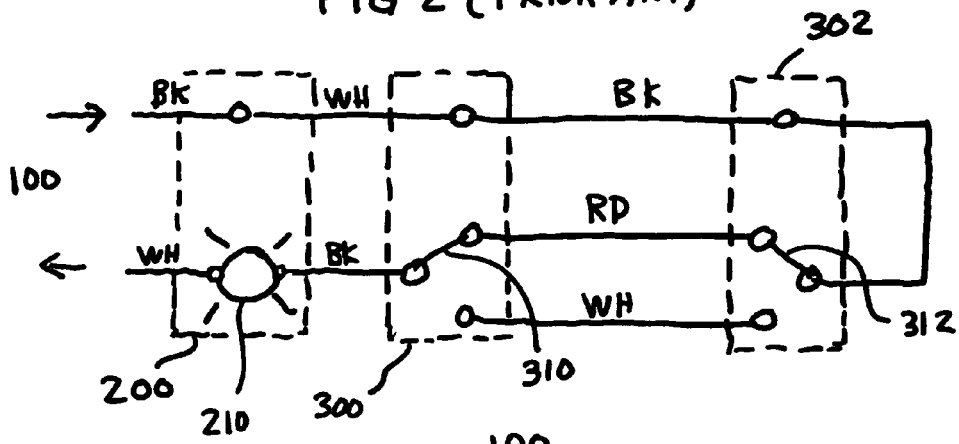
FIG 2 (PRIOR ART)
FIG. 2 is a schematic diagram of a prior art circuit for a three-way switch having a light, a first switch and a second switch with power entering the light and then going to one switch.
Figure 3:
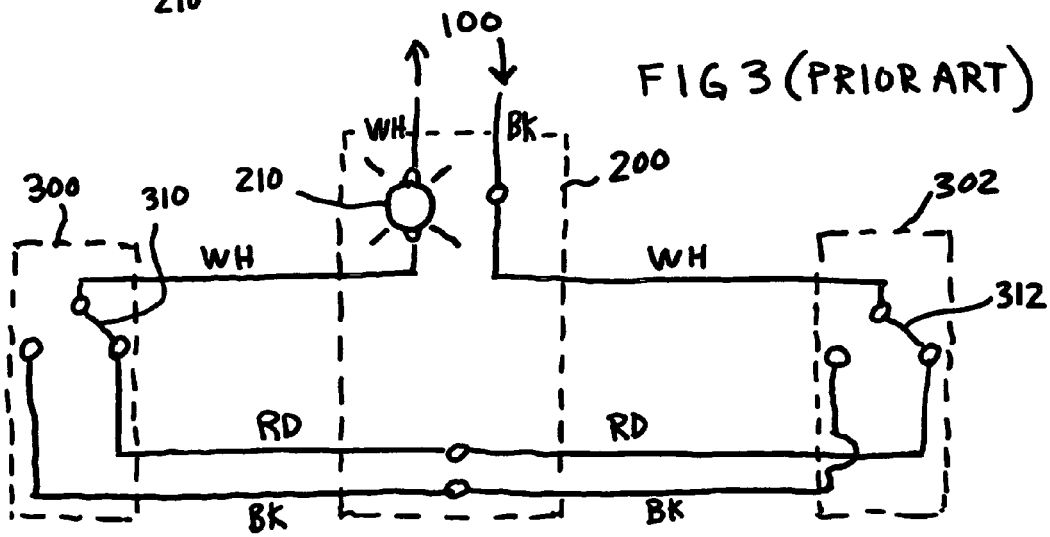
FIG 3 (PRIOR ART)
FIG. 3 is a schematic of a prior art circuit for a three-way switch having a first switch, a light and a second switch with power entering the light and then going to both switches.

Referring to FIGS. 1, 2 and 3, three different ways or applications are shown for the use of three way switches. A first application is shown in FIG. 1. The source of power or electricity 100 enters a first three-way switch enclosure 300 and connects to a first three way switch 310 by way of a two conductor cable with a ground called Romex® or NM (non metallic) cable. The power then travels to the next three-way switch 302 enclosure and connects to the second three way switch 312 by way of a three conductor cable with a ground. From there, power is delivered to the light 200 enclosure and connected to the light 210, a number of lights, or any controlled device via the 2 conductor with ground cable.

Referring now to FIG. 2, a second application is shown. The power source 100 enters the light fixture enclosure 200 and is connected to the light 210 first and then travels on to the first three-way switch enclosure 300 and connects to the first three-way switch 310 and then to the second three-way switch enclosure 302 and connects to the second switch 312.

Referring to FIG. 3, a third application is shown. The power source 100 enters the light fixture enclosure 200 first via a two conductor cable with ground and then goes to two separate three-way switches, 310 and 312 by way of two separate three conductor cables with ground.

The current method of wiring switches, receptacles, light fixtures, or any electrical device, is done by terminating the NM cable into a box and hard wiring it to the electrical devise, then mounting the devise in the box. NM (non metallic cable) comes in various wire sizes or gauges with a number of conductors within its outer jacket. When wiring a three-way switch, four conductors in the NM cable are required. The individual conductors are color coded; black, red, white, and a ground wire that has no jacket or insulation indicated by the color green. The red and black wires are often called traveling wires because the current travels back and forth between the two 3 way switches via these wires and is controlled by the main switch. In order for any electrical circuit to function properly the electrical current has to return back to the power source, making a complete loop, or circuit. This is normally done by the neutral (white) wire. As used in this application, references in the Figures to BK, WH, RD ad GN are intended to make reference, respectively, to the black, white, red and ground wires of a Romex or other nonmetallic cable.

The four individual conductors are mechanically attached to the back of the switch to four different terminations. The ground is always connected to the same terminal which is marked "ground" and is usually indicated by a green screw. The other three conductors, black, red, and white however, can be terminated to any of the other three terminals determined by the application being used as previously described. The electrician therefore, has to make his terminations according to the desired application.

The switches of the present invention will not be like the conventional switch. It has been previously explained how the wires have to be connected to the back of a conventional switch and then the switch has to mounted into a box. The present switch is complete and factory sealed in its own box (which is called an enclosure) with a receptacle and terminals to accept a newly designed connector. The use of a new connector being developed by Aslan Industries which will be sold under the trademark Q-CEB™ (also referred to as a Quick-Connect Electrical Box) connectors will allow the electrician or end user to simply plug the NM cable into the back of the designed enclosure for the switches. As used in this application, the term "quick connector" refers to a structure similar to that described in Libby, U.S. Pat. No. 5,975,938 (FIG. 1) or in Libby et al., United States Patent Application, Publication No. 2005/0064759 A1 (FIG. 1) or any similar device which provides a male (or female) connector on the terminal end of a NM cable to allow for a plug in type connection to a switch box, receptacle box or other electrical device.

Because a "quick connector" is used, the labor performed in making mechanical connections on the switch is eliminated. However, the three-way switch still has to function in any of the three applications described above with respect to FIGS. 1, 2 and 3. To accomplish this, the three-way switch has to be configured and designed so that all three applications of the wiring circuits may be performed. This is accomplished by the use of internal bussing and cams within the switch. Upon installation, the installer will set the cams on the back of the switch according to the application being applied described in directions included with every switch.

The following descriptions will explain how setting the cams can direct the flow of current and thus allow the switch to be correctly utilized in any of the three applications shown in FIGS. 1, 2, and 3 which show different ways that three-way switches are used.

Figure 4:
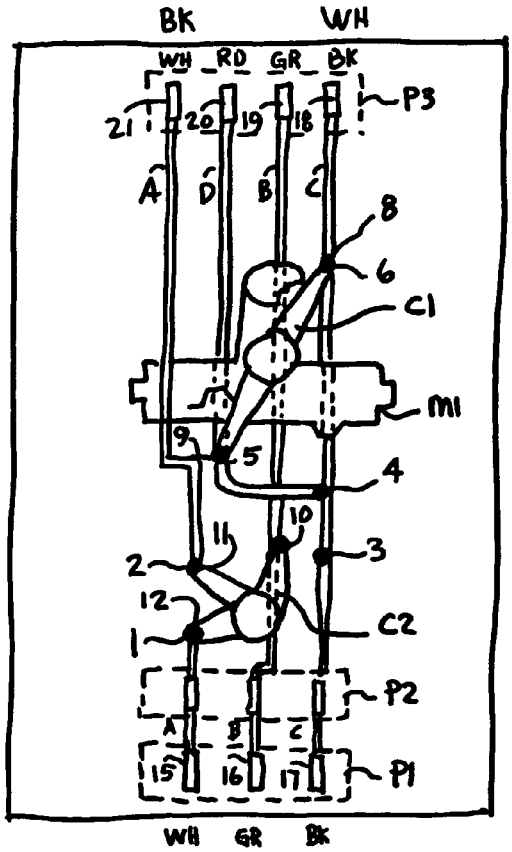
FIG. 4 is a top plan view of a three-way switch according to the present invention.
Figure 5:
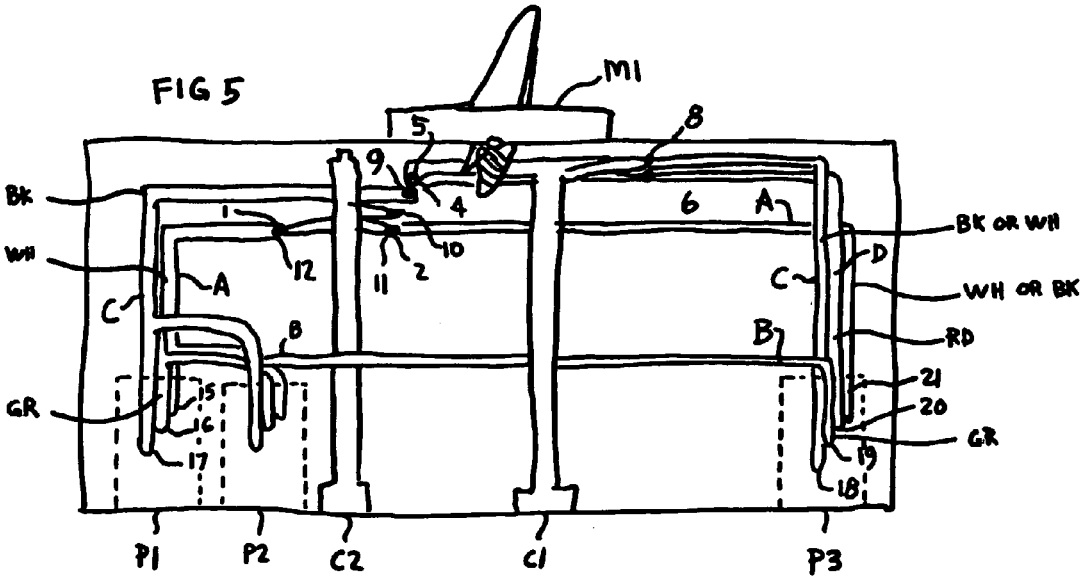
FIG. 5 is a perspective view of the three-way switch of FIG. 4.
Figure 5A:
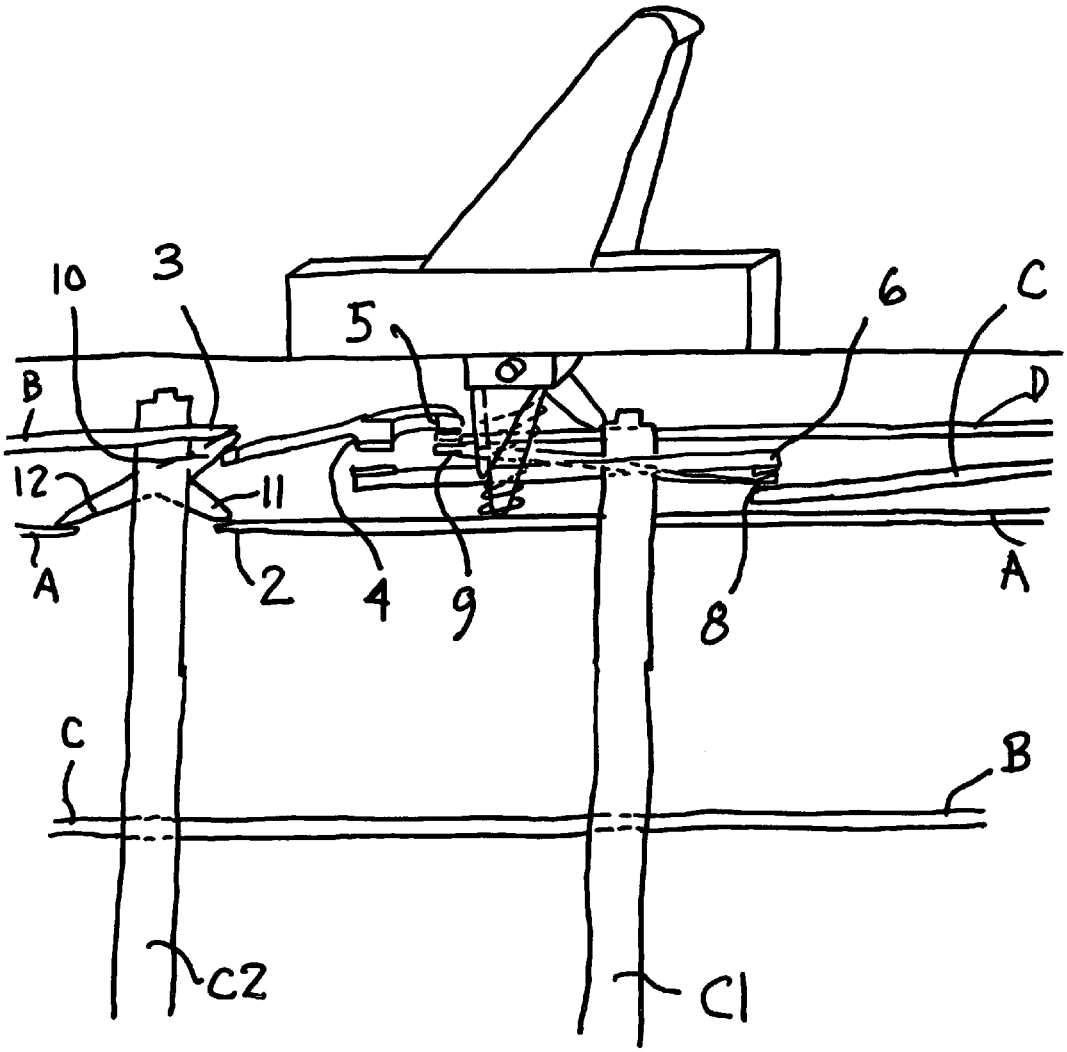
FIG. 5*a* is an enlarged view of a portion of FIG. 5 showing the details of the main switch, the first cam and the auxiliary cam.

To examine the overall switch and its parts reference is first made to FIGS. 4, 5 and 5*a* which generally show the internal grid, cams, and parts that make up the three-way switch. FIG. 4 shows a top view and FIG. 5 shows a perspective side view of the switch. There are three ports, P1, P2, and P3, in the back of the switch that will accept "quick connect" connectors to transfer the current from the cable to the bussing in the switch. The metal bussing A, B, C, & D, will carry the current from one port to another through various contact points 1 thru 21. As will become more apparent, bussing segments A, C and D are not continuous but rather are formed to have multiple segments with ends of each segment forming a contact point. The main switch M1 controls the entire circuit. When M1 is in one position the contact point at 4 will be closed and point 5 will be open. As used in this application, the term "open" means that juxtaposed ends of adjacent bussing segments are not in electrical contact with one another but rather are spaced apart and separated by either air or by a solid insulating member inserted there between. In contrast, the term "closed" means that juxtaposed ends of adjacent bussing segments are in physical contact with one another and make an electrical connection.

When M1 is thrown in the opposite direction, contact point 4 will open and contact point 5 will close. This action "flip-flops" the flow of current through the switch allowing the two switches to control the circuit. Finally, we have a set of cams marked C1 which designates the auxiliary cam and C2 which designates the first cam, along with special bussing, allows this three-way switch to be used in all three applications of circuitry from one self-contained electrical enclosure (box). These cams can be turned, using a screw driver, from the back side of the switch. The auxiliary cam C1 will have an insulating wedge on the bottom of both contact points 8 and 9, which will also be wedged shaped. This will make it possible to open the split busses C and D when put in the position needed for the application, and also allow the current to follow the correct path or bus according to the desired application. The first cam C2 has a wedge shaped insulator and contact point at 10 allowing the split bus C to open at point 3. This allows the current to flow only in the direction stated for the desired application.

Figure 6:
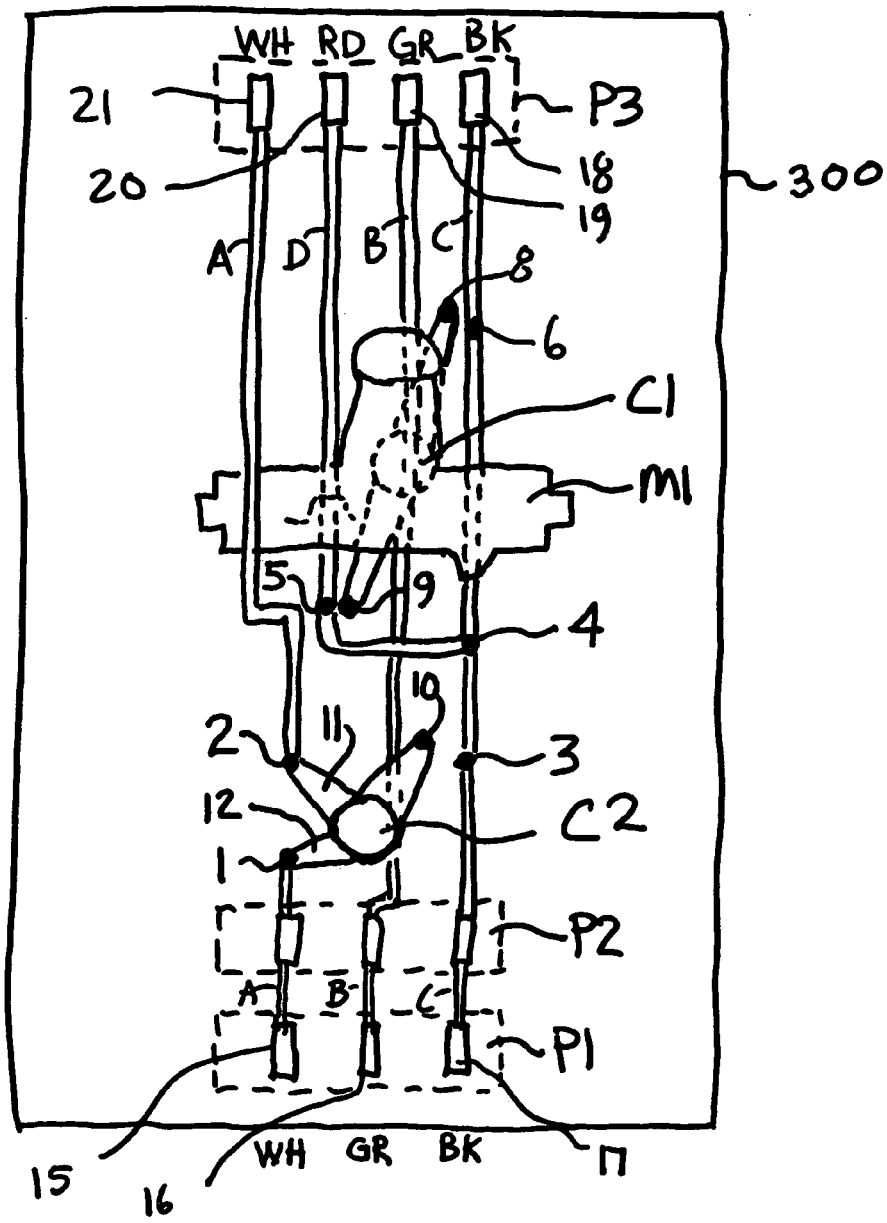
FIG. 6 is a top plan view of a first switch according to the present invention having a first cam in a first position and having an auxiliary cam and a first auxiliary cam position.
Figure 7:
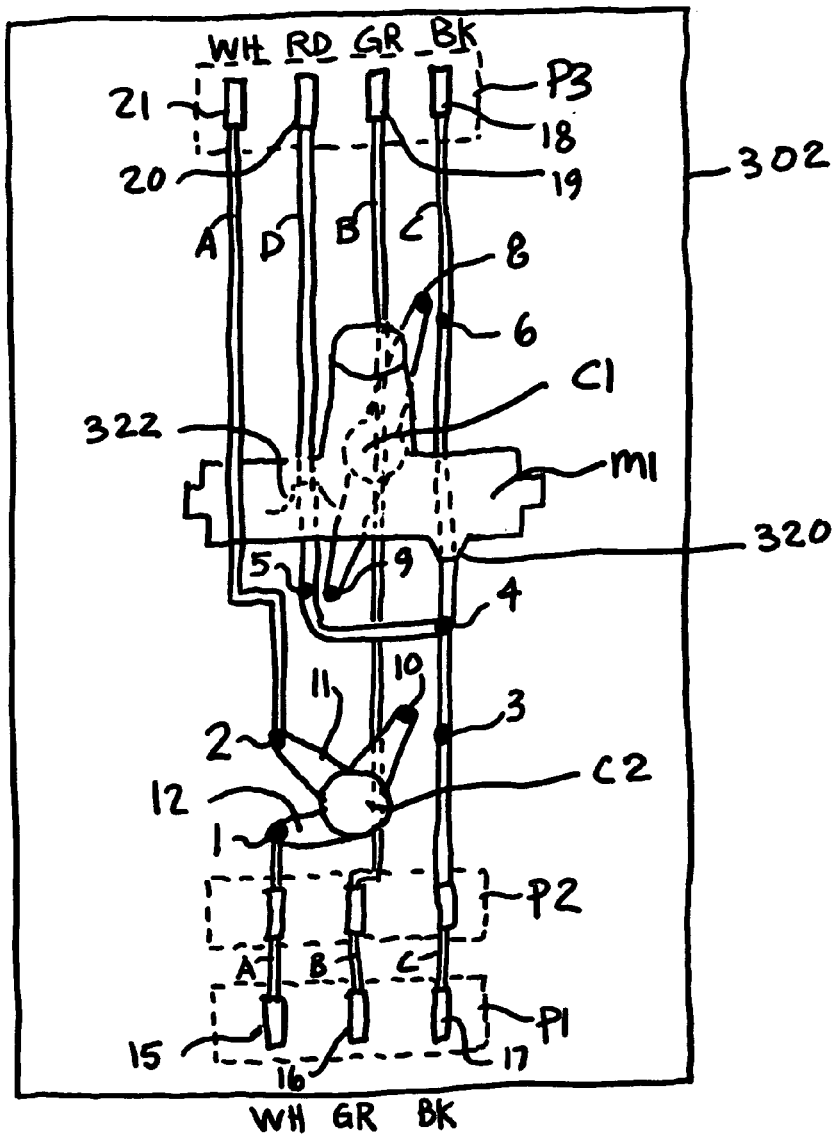
FIG. 7 is a top plan view of a second switch according to the present invention having a first cam in a first position and having an auxiliary cam in a first auxiliary cam position.

The use of the present invention will now be described with respect to some specific applications. Application 1 utilizes a circuit having an electrical wiring schematic as shown in FIG. 1. The electrical current 100 is brought first to the boxes 300 and 302 which contain switches 310 and 312, respectively, and then to the box 200 in which the light fixture 210 is mounted. FIG. 6 and FIG. 7 show switch enclosures 300 and 302, respectively, and the positioning of the auxiliary cam C1 and cam C2 for this circuit. For switch enclosure 300 to turn the light on, the main switch M1 is in position shown. Current will enter port P1 at 17 from the power source, travel along bus C and through contact points 3 and 4. Point 5 will be open. Current continues through point 6 which will be closed and to 18 located in P3. The current exist the switch enclosure 300 through a "quick connect" connector on to the other three-way switch enclosure 302, via a four conductor cable and second "quick connect" connector.

In FIG. 7 the main switch M1 is in the position shown and all points along bus C are closed. Current will enter port 3 and at 18, travel through bus C to 17 and out through a "quick connect" connector that is inserted into port P1 and to the light 210 or devise you want to control. In this first application, the current travels through the light and to the neutral wire connected to the light and back to port 15 of the switch enclosure 302 in FIG. 7. With the cam C2 in the position shown, the current will flow along bus A without interruption and back to switch enclosure 300. Entering switch enclosure 300 at port P3, point 21, the current, travels through bus A and points 2, 1, and 15, and back to the power source making the complete trip and completing the circuit. To turn the light off, the main switch M1 in either switch enclosure 300 or 302 is thrown in the opposite direction opening the circuit and breaking the "loop". To turn the light back on at switch enclosure 300, throw main switch M1 in the opposite direction, this opens 4 and closes 5 allowing current now to flow through bus D and on to switch 302 to port P3, point 20 through points 5, 4, 3, and onto 17 and then to the light 210. Note that port P2 is only used for a feed through, meaning that port P2 allows the user to feed power to other devices, (switches, junction boxes, etc.). This port P2 can be used in two applications, namely, the applications shown in FIG. 1 and FIG. 2.

Figure 8:
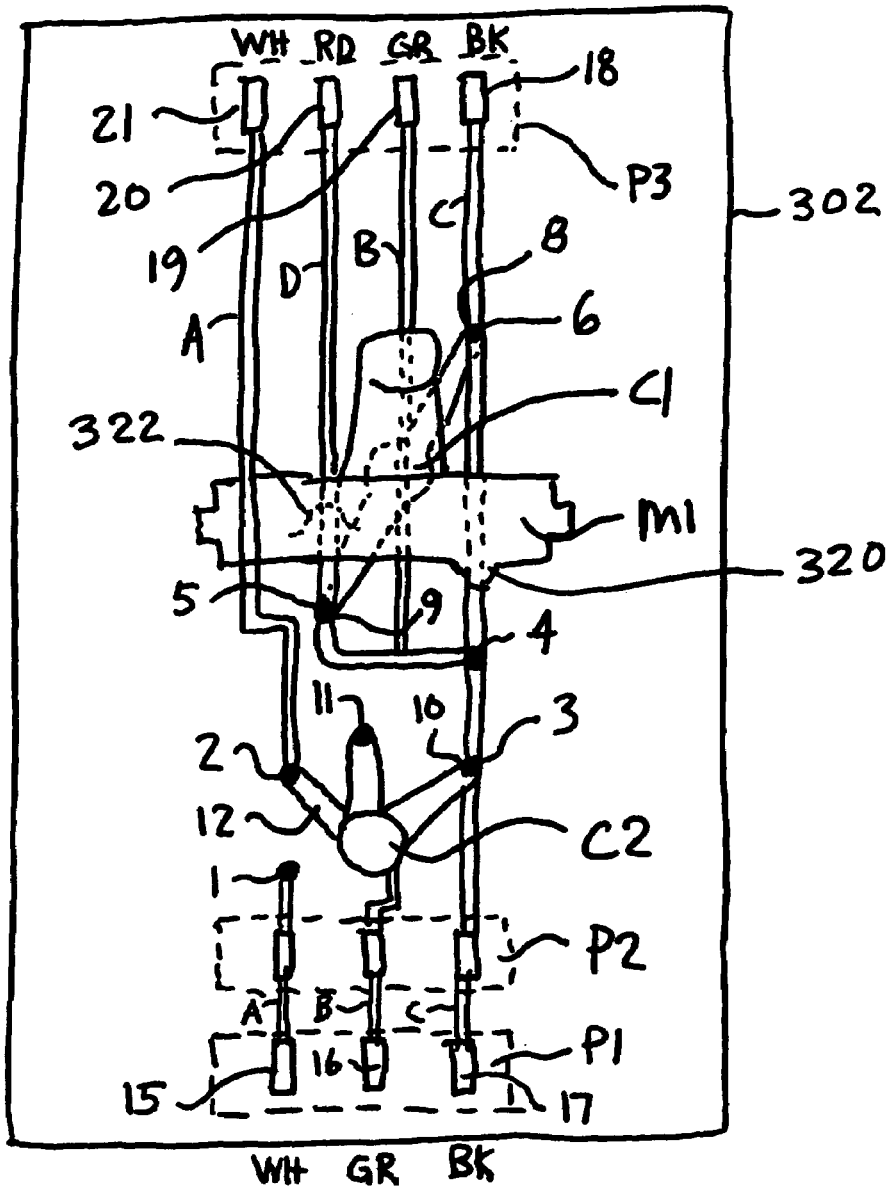
FIG. 8 is a top plan view of a second switch according to the present invention having a first cam in a second position and having an auxiliary cam in a second auxiliary cam position.

Application 2 utilizes a circuit having an electrical wiring schematic as shown in FIG. 2. In this circuit, the electric current 100 first enters the box 200 in which the light 210 is wired and then goes to the three-way switch enclosures 300 and 302. In this application, the white wire going from the light 210 to the switch enclosure 300 will be wired such that it will carry the current. Our directions will simply describe how to terminate the Romex in our connector. In switch enclosures 300 and 302 the cams will be set in the position shown in FIG. 6 and FIG. 8. Current coming from the light fixture box 200 will enter switch enclosure 300 (FIG. 6) at port P1, point 15 and travel through bus A and points 1, 12 and 11 on cam C2, to points 2, 21, and out of port P3 traveling to switch enclosure 302 (FIG. 8) via a four conductor cable. Current will enter port P3 at 18, travel along bus C to 6, at 6 the auxiliary cam C1 will position point 8 at 6 allowing current to flow over to bus D or continue along bus C determined by the position of main switch M1. The main switch M1 can then cause the (flip-flop) or switching of current flow in a manner well known with knuckles 320 and 322. If the main switch M1 is in the position shown in FIG. 8, the current will travel from 6 to 4, to point 3, and with the auxiliary cam C1 in position shown, travel through 10 and 12 to point 2. At point 2, the current flows through bus A, into port P3, to 21, through a "quick connect" connector and back to switch enclosure 300 the 4 conductor cable to port P3 and point 18. The current will continue through bus C, through 6, 4, 3, 17, out of P1 and back to the light fixture box 200 to complete the "loop" and turn the light 210 on. The main switch M1 in either switch enclosure 300 or 302 can be thrown in the opposite direction to "break", or interrupt the circuit and turn the light 210 off. This is accomplished by main switch M1 opening either point 4 or 5. Turning the light 210 back on from switch enclosure 302, the current flow will be as follows: Main switch M1 is now in the opposite direction, opening point 4 and closing 5. Current will flow from 6, through 8 on auxiliary cam C1, to point 9 on the auxiliary cam C1, to 5, and along bus D to point 20 in port P3. From there it will travel through the red wire in the four conductor cable back to switch enclosure 300 entering port P3 at 18, travel through bus D to point 5, to 4, 3, 17 in port P1, and to the light fixture box 200 completing the "loop" once again and energizing the light 210.

Figure 9:
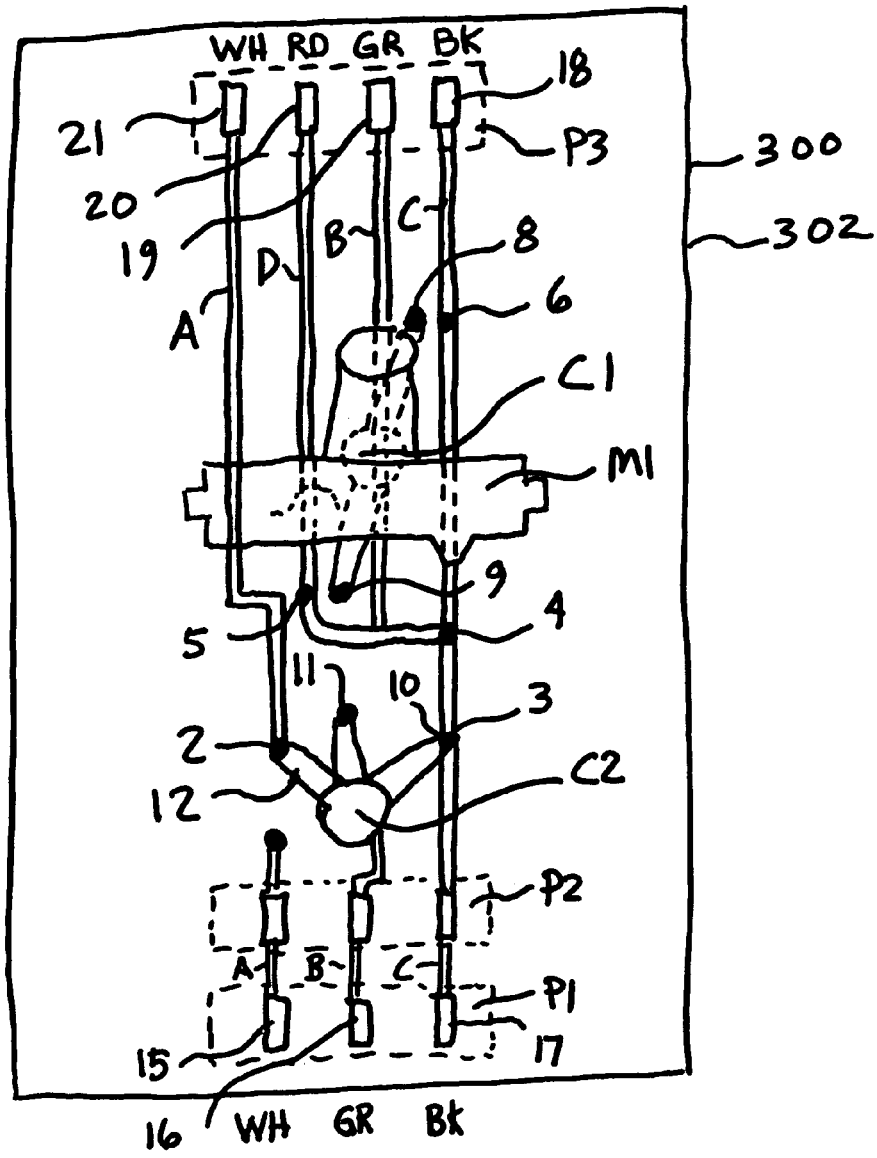
FIG. 9 is a top plan view of a first switch and a second switch according to the present invention having a first cam in a second position and having an auxiliary cam in a first auxiliary cam position.
Figure 9A:
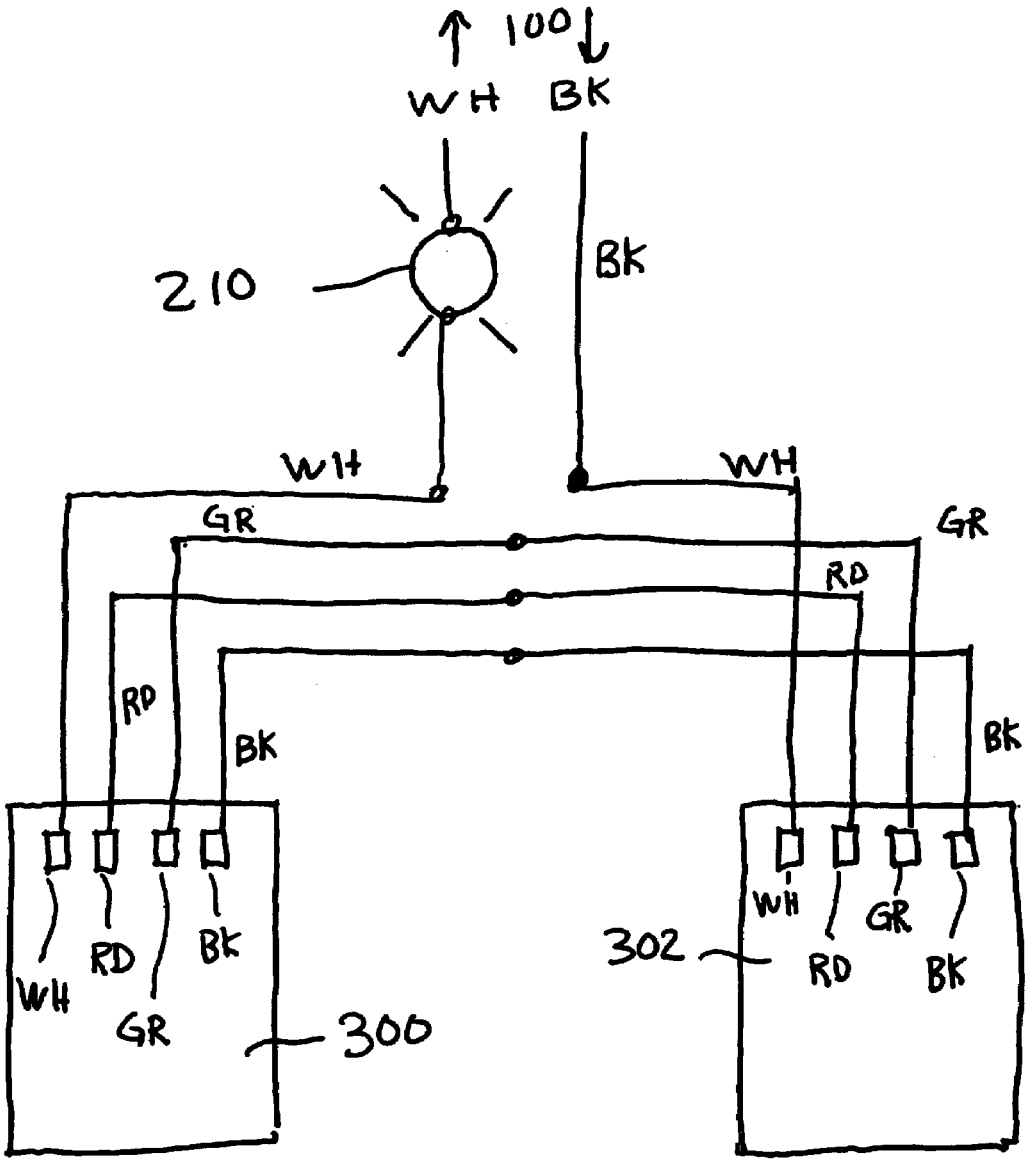
FIG. 9*a* is a typical wiring diagram for the 4-conductor port P3 of FIG. 9.

Application 3 utilizes a circuit having an electrical wiring schematic as shown in FIG. 3. In this circuit, the power is fed to the light fixture 200 first. It is then fed to the two switch enclosures 300 and 302 by way of two separate three conductor cables. Although this application is rarely used, we still must provide a way to apply this method. The auxiliary cam C1 and cam C2 are set in the same position in both switch enclosures 300 and 302 as shown in FIG. 9. In this application, the current 100 will come from the light fixture box 200, go to one switch enclosure 302, make a loop, and back to the other switch enclosure 300 and then return to the light 210. The black wire in the light fixture box will be connected to the white wire of the four conductor cable that will carry the current to the switch enclosure 303. In port P3 at 21, current will travel along bus A to points 2, 12, 10, and point 3 on bus C. It will then travel either to bus D at point 4 or continue on bus C to 6, depending on which position the main switch M1 is in. When main switch M1 is in the position shown in FIG. 9, 5 is open and the current will flow in bus C, to 6, to 18, out of port P3 to the black wire and to switch enclosure 300. Entering switch enclosure 300 at 18 traveling along bus C through 4 to 3, through the cam C2, points 10 and 12 to 2, through bus A to 21, out of port P3 and back to the light fixture 200 completing the circuit and turning the light 210 on. Flipping the main switch M1 in either switch enclosure 300 or 302 will open point 4, opening the circuit and turning the light 210 off. Point 5 is now closed allowing the current to flow through bus D. If main switch M1 in switch enclosure 300 is in the opposite position shown and the light is now off, switch enclosure 302 can turn the light 210 back on and the current will flow as follows. Current still enters at port P3, point 21, travels along bus A through points 2, 12 and 10, to 3 and up to 4. Point 4 is now open by the main switch M1 and point 5 is closed so the current will now flow over to bus D and travel through 5 to 20, out of port P3 through the red conductor to port P3 in switch enclosure 300 at 20, along bus D to 5, over to 4 which is also open causing the current to flow to 3, 10, 12, 2, through bus A, to 21, out of port P3 via the white wire and back to the light 210 completing the circuit once again and energizing the light 210.

Figure 10:
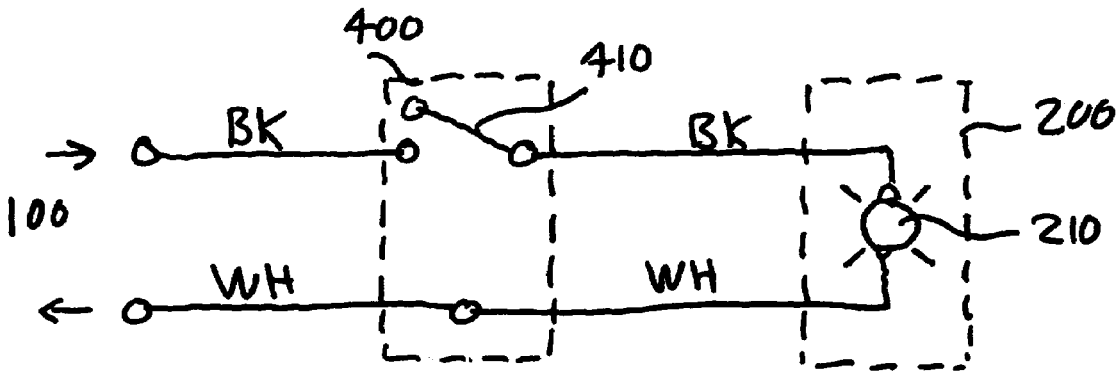
FIG 10 (PRIOR ART)
FIG. 10 is a schematic diagram of a prior art circuit for a single pole switch having a first switch and a light with power entering the first switch.
Figure 11:
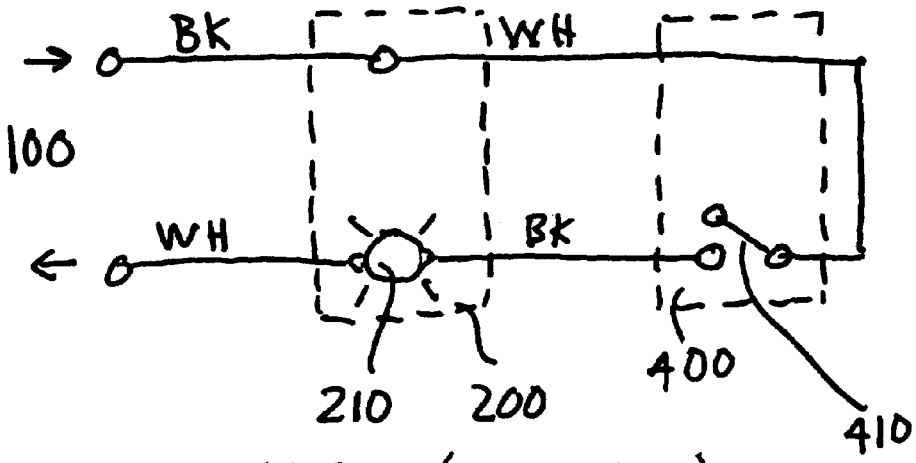
FIG 11 (PRIOR ART)
FIG. 11 is a schematic diagram of a prior art circuit for a single pole switch having a light and a first switch with power entering the light.

The present invention also has utility in the installation of single pole switch circuits. For this application, only a single cam C2 is utilized. The single pole switch, although simple in design, has two basic wiring applications. In application 1, shown in FIG. 10, the circuit can be wired in a way that the power source 100 can feed the switch 410 in switch enclosure 400 first and then to the light fixture 200. In application 2, the power may enter the light fixture 200 and then the switch enclosure 400. The wiring schematics are shown in FIG. 10 and FIG. 11, respectively. Single pole switches also use Romex or NM (non metallic) cable and is always a three conductor cable consisting of a black and white wire and a bare ground wire. The black is the current carrying or "hot" conductor and the white is the "neutral" which carries the current back to the power source. FIGS. 14 and 14*a* and FIGS. 15 and 15*a*, respectively, shows the internal grid and the cam C2 that will be used to allow the two applications to be applied using a "quick connect" connector. This newly designed switch enclosure 400 enables the electrical contractor not only to utilize both applications of circuitry, but also decreases time and labor costs.

Figure 14:
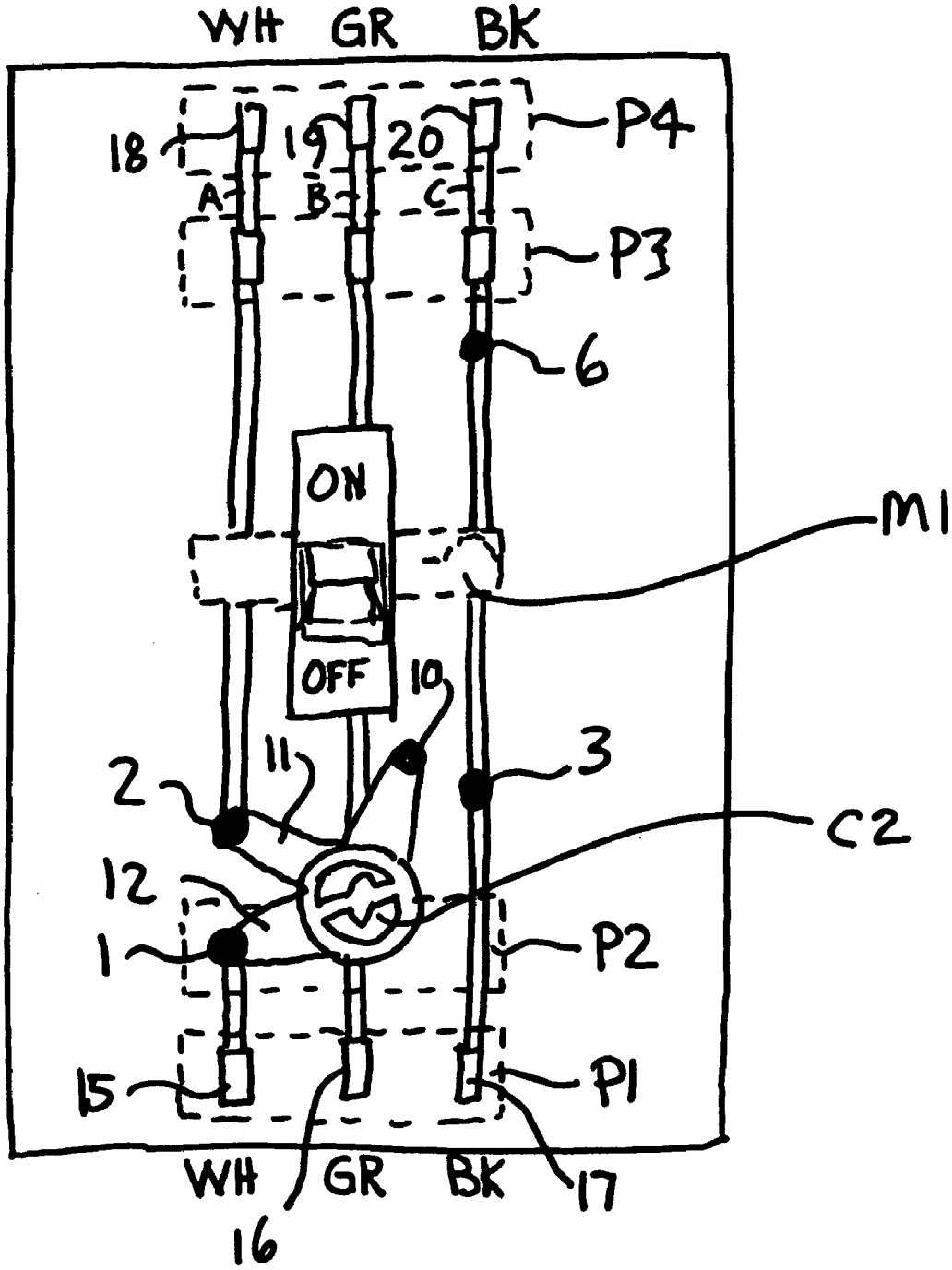
FIG. 14 is a top plan view of a single pole switch according to the present invention showing the cam in a first cam position.
Figure 14A:
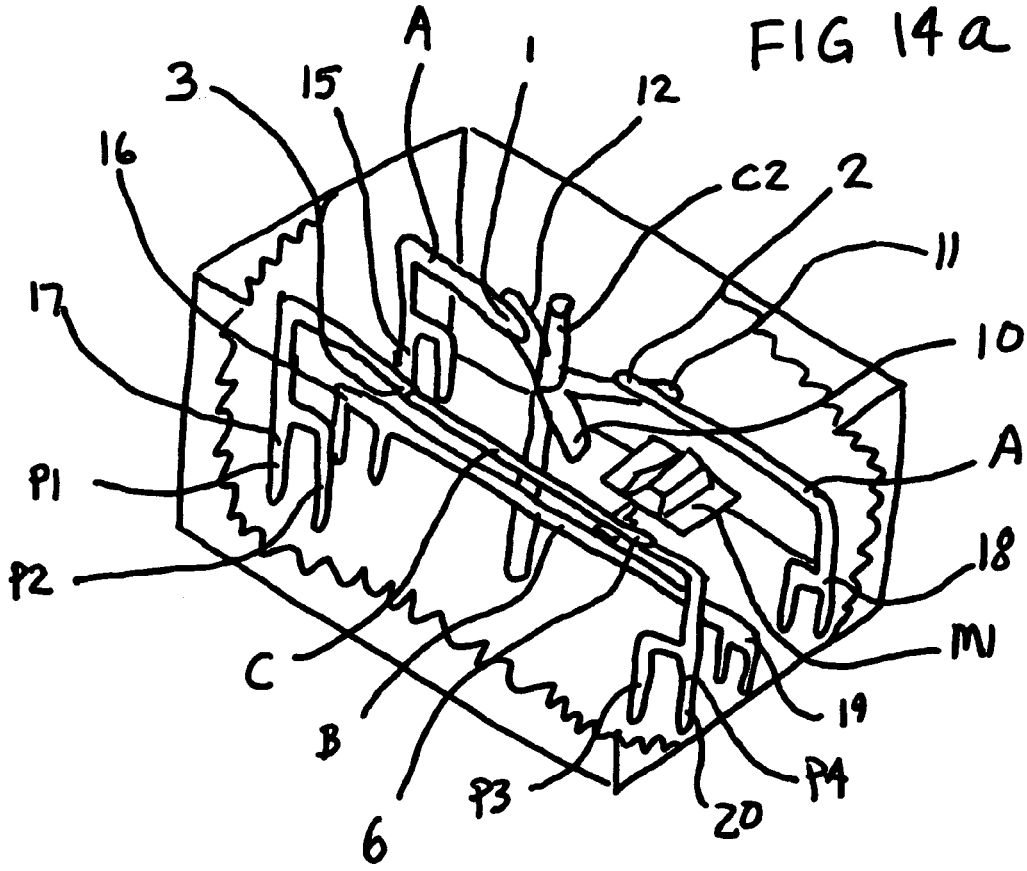
FIG. 14*a* is a perspective view of the single pole switch of FIG. 14.

FIG. 10 shows the wiring schematic for the first application. FIG. 14 And FIG. 14*a* show the internal busing, the cam C2 and its configuration, and the contact points for this circuitry. Current flowing from the power panel, or source, will first enter the switch 400, FIG. 14, at port P1 at point 17. It will travel along bus C to point 3. Cam C2 is in the position shown and main switch M1 is in the "on" position, closing point 6 and allowing current to flow through the busing to point 20, out of port P4, and to the light fixture 200. It continues through the light 210 to the white or neutral wire and back to the switch (FIG. 14) at port P4, point 18. The current continues through the A bus to point 2, 11 and 12 on the cam C2, to point 1, to 15, then travels back to the power source completing the "loop" or circuit. Turning the light 210 off is simply done by throwing the main switch M1 to the "off" position thereby "opening" the circuit at point 6.

Figure 15:
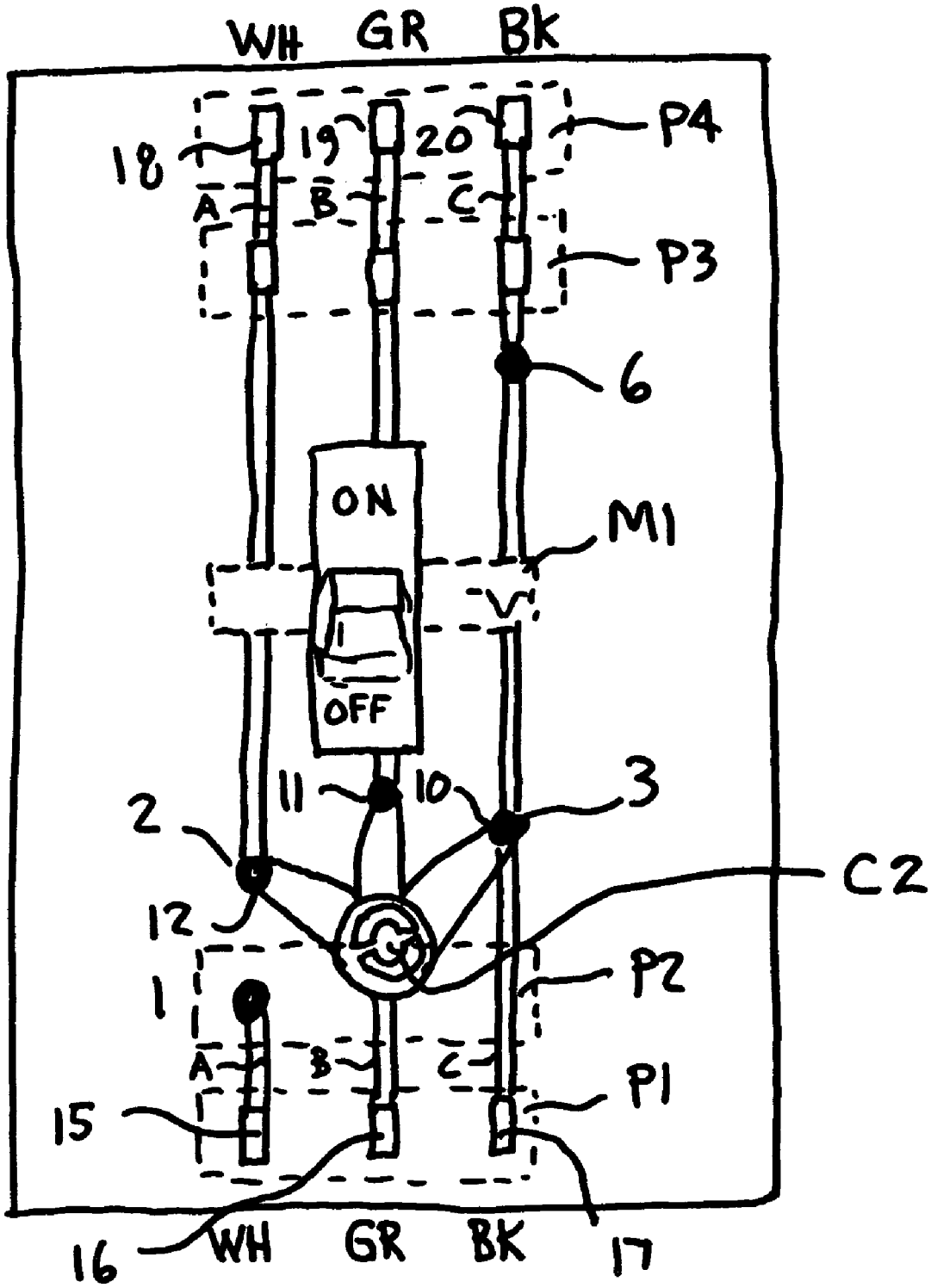
FIG. 15 is a top plan view of a single pole switch according to the present invention showing the cam in a second cam position.
Figure 15A:
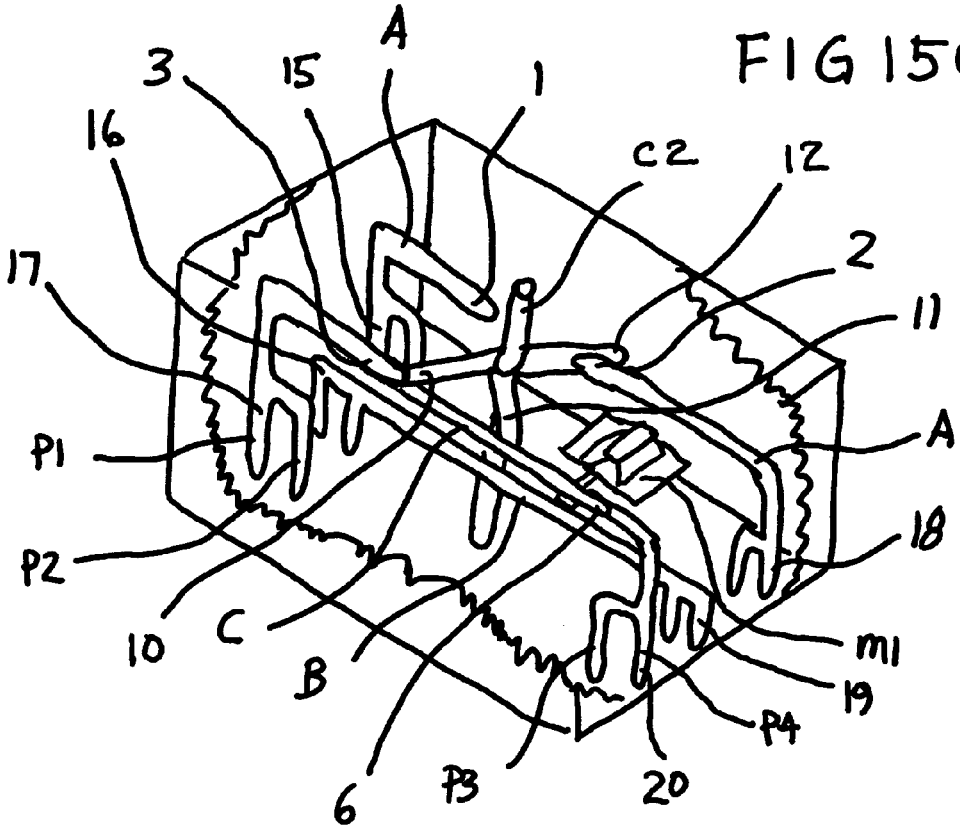
FIG. 15*a* is a perspective view of the single pole switch of FIG. 15.

FIG. 11 shows the wiring schematic for the second application. In this application, the power source 100 feeds current to the light fixture box 200 first and then travels to the controlled switch 400. FIG. 15 and FIG. 15*a* represent the bus system, the cam C2, the main switch M1, the contact points, and the ports. Looking at FIG. 15 and FIG. 15*a*, we follow the current. The power 100 comes through the light fixture 200 and goes to the switch enclosure 400 entering port P4 at 20. It travels along the C bus through point 6. The contact point 6 is closed when the main switch M1 is in the "on" position, and the current flows to point 3. The cam C2 is now in the position shown by setting before installation, contacting points 3 and 10. The contact point at 10 will be wedged in shape, insulated on the bottom, and will come between the split bus of C, or open the contacts at point 3 allowing current to only flow through the cam C2. Current will now flow through the auxiliary cam points 11 and 12, on to point 2, to bus A, and then to 18 in port P4. From port P4 back to the light fixture 200 and return to the power source, completing the circuit. The main switch, M1, is thrown in the "off" position to open contact point 6, stopping the flow of current, and turning the light or device off.

Figure 16:
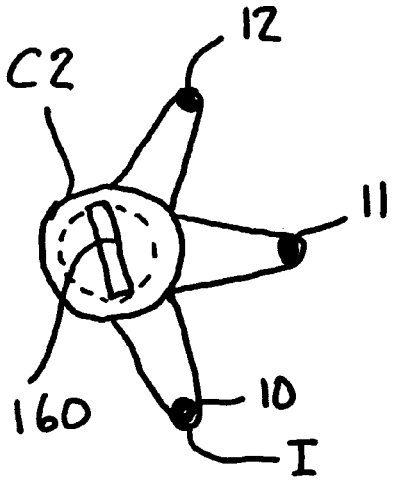
FIG. 16 is a top plan view of the cam of the present invention.
Figure 17:
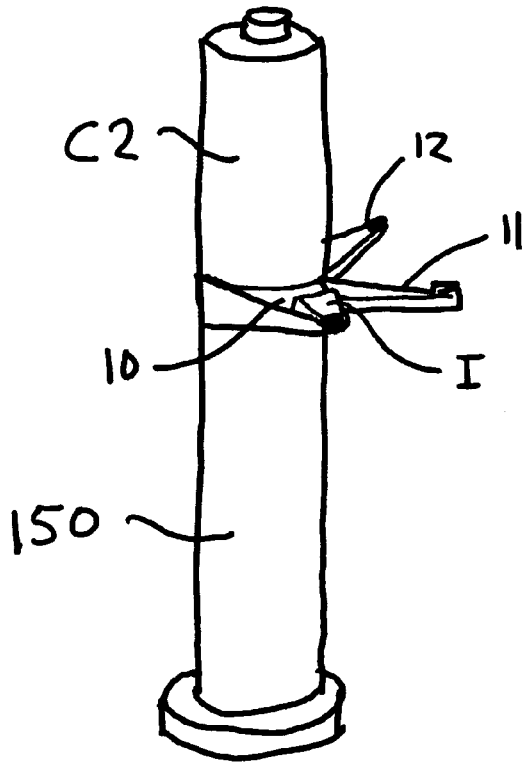
FIG. 17 is a side perspective view of the cam of the present invention.

Referring to FIG. 16, a top plan view of the cam C2 is shown. Cam C2 includes arm members 10, 11 and 12 which extend radially outward from a main shaft 150. The top of the shaft 150 is provided with a groove 160 into which a screw driver or other device may be inserted to allow the camshaft 150 to be rotated from a location outside of the factory sealed enclosure in which the cam C2 is housed. As shown in FIGS. 16 and 17, and insulating wedge member 1 is provided on a lower surface of the end of arm member 10.

Figure 19:
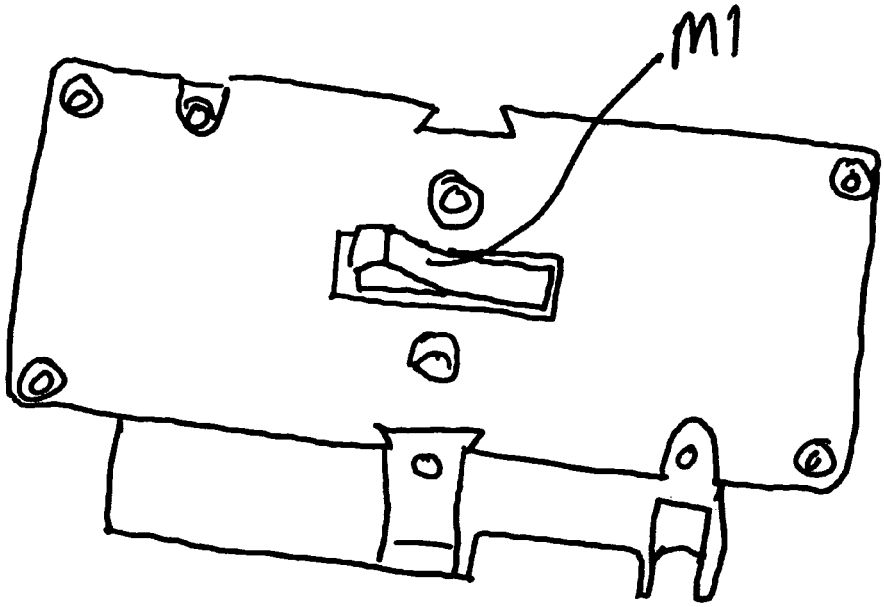
FIG. 19 it is a perspective view of the front of the switch of FIG. 18.
Figure 18:
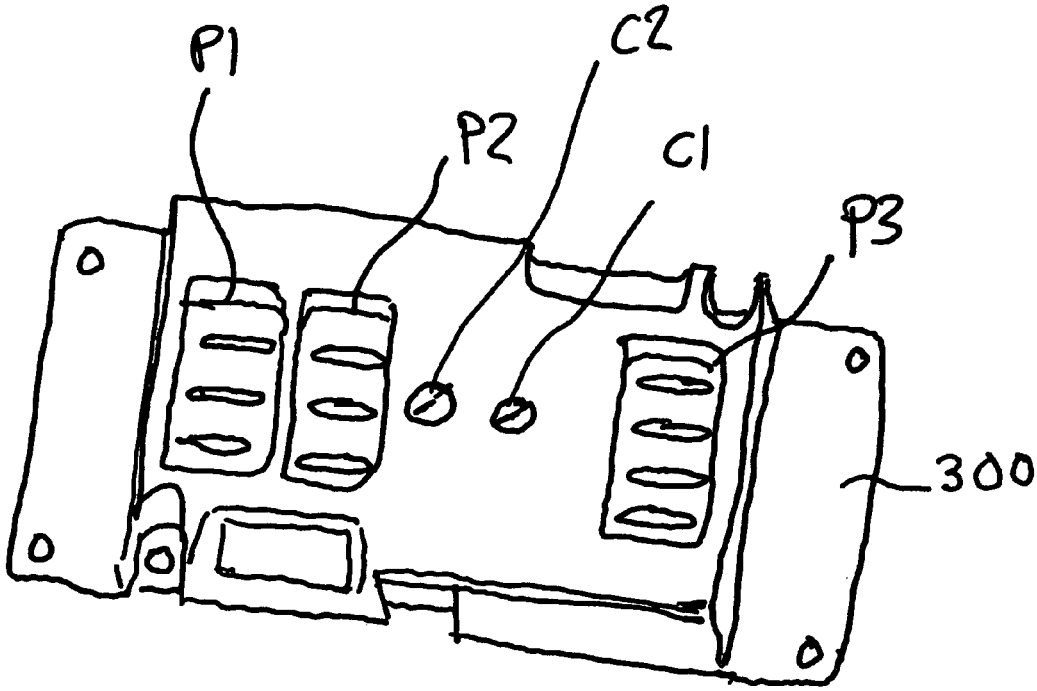
FIG. 18 it is a perspective view of the back of a sealed receptacle for the three-way switch of the present invention.

FIG. 18 and FIG. 19 show, respectively, a perspective view of the bottom and top surfaces of a sealed switch enclosure 300. A main toggle switch M1 is provided on the top surface and ports P1, P2 and P3 are provided on the bottom surface. A groove provided in an end of each of auxiliary cam C1 and first cam C2 are also accessible from the bottom surface.

Figure 21:
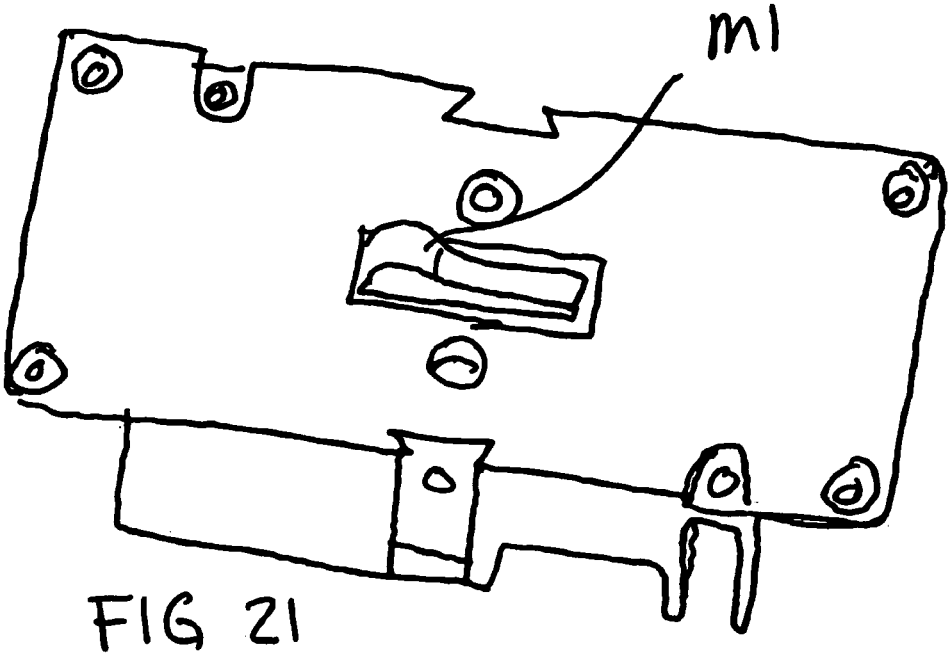
FIG. 21 is a perspective view of the front of the switch of FIG. 20.
Figure 20:
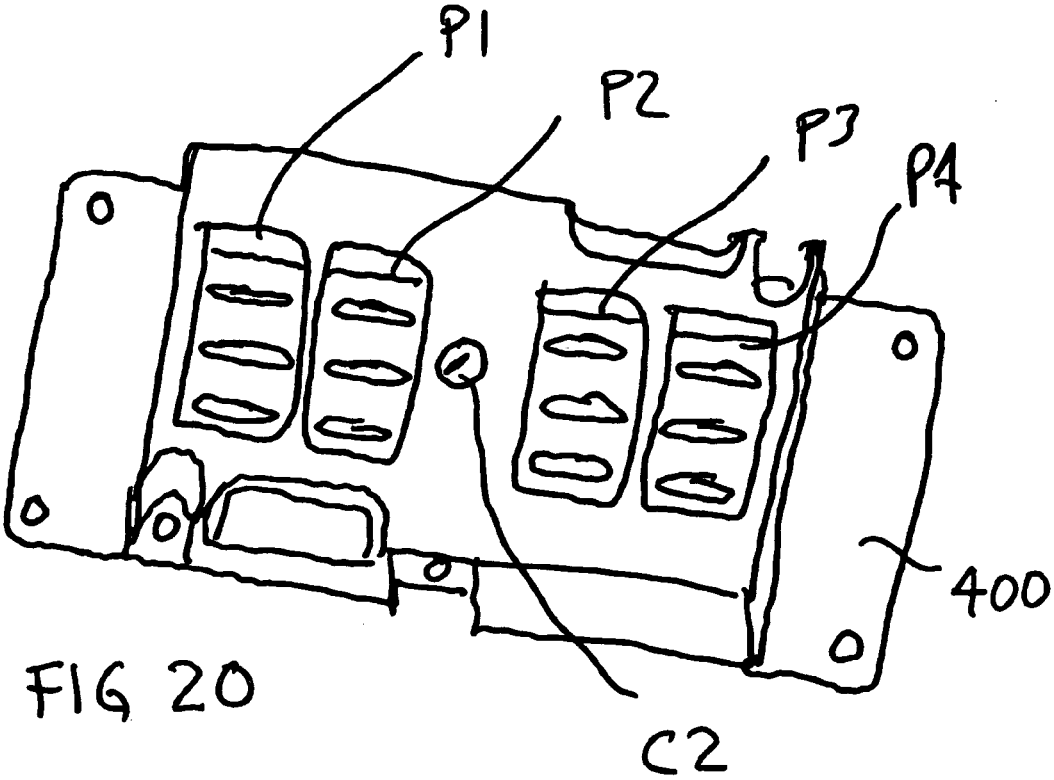
FIG. 20 is a perspective view of the back of a sealed receptacle for the single pole switch of the present invention.

FIG. 20 and FIG. 21 show, respectively, a perspective view of the bottom and top surfaces of a sealed switch enclosure 400. A main toggle switch M1 is provided on the top surface and ports P1, P2, P3 and P4 are provided on the bottom surface. A groove provided in an end of cam C2 is accessible from the bottom surface.

It is to be understood that while certain forms of the present invention have been illustrated and described herein, the present invention is not to be limited to the specific forms or arrangements of parts described and shown.

I claim:

1. A switch for electric cable wiring comprising:

a) an enclosure having an input port and an output port;

b) a toggle switch;

c) a cam having cam arms, said cam movable between a first position wherein said arms electrically connect and close return bus cam contact points of adjacent return bus segments and a second position wherein said arms electrically connect and close a power bus cam contact point of a power bus segment to a return bus segment;

d) a power bus extending in segments between said input port and said output port, said power bus having a main contact point selectively opened and closed by said toggle switch, said power bus having the power bus cam contact point selectively opened and closed by said cam;

e) a return bus extending in segments between said input port and said output port, said the return bus having return bus cam contact points selectively opened and closed by said cam; and f) a ground bus extending between said input port and said output port.

2. A switch according to claim 1 wherein said enclosure has an exterior and said input port and said output port are accessible from the exterior of the enclosure.

3. A switch according to claim 1 wherein said input port and said output port each provide a separate and independent connection to said power bus, said return bus and said ground bus.

4. A switch according to claim 1 wherein said enclosure is factory sealed and has an interior which is inaccessible to an installer.

5. A switch according to claim 1 wherein said cam has three arm members.

6. A switch according to claim 5 wherein one of said arm members has an electrically insulating material on one side thereof.

7. A switch according to claim 1 wherein said cam has a shaft rotatable between said first position and said second position.

8. A switch according to claim 1 wherein said cam has a shaft which extends at least partially through an exterior of the enclosure and can be rotated between said first position to said second position from a location outside the enclosure.

9. A switch according to claim 1 wherein said cam has an arm member which has a wedge like side surface for urging apart and opening one of said contact points on one of said bus segments when said cam is rotated between said first and said second postion.

10. A switch according to claim 1 further comprising:

g) a second power bus, said second power bus extending in segments between said output port and said power bus;

h) an auxiliary cam, said auxiliary cam having auxiliary cam arms and movable between a first auxiliary cam position wherein said auxiliary cam arms do not contact any of the busses and a second auxiliary cam position wherein said auxiliary cam arms electrically connect any contact point of said second power bus to a contact point of said power bus.

11. A switch according to claim 10 wherein said auxiliary cam has two arm members.

12. A switch according to claim a 10 wherein said auxiliary cam includes an auxiliary cam shaft rotatable between said first auxiliary cam position and said second auxiliary cam position.

13. A switch according to claim 10 wherein said auxiliary cam has an auxiliary cam shaft which extends at least partially through an exterior of the enclosure and said cam can be rotated between said first auxiliary cam position to said second auxiliary cam position from a location outside the enclosure.

14. A switch according to claim 10 wherein said auxiliary cam has an auxiliary cam arm member which has a wedge like side surface for urging apart and opening a contact on one of said bus segments when said auxiliary cam is rotated between said first auxiliary cam position and said second auxiliary cam position.

* * * * *